US005611225A

United States Patent [19]

Resch et al.

[11] Patent Number: 5,611,225

[45] Date of Patent: Mar. 18, 1997

[54] BREAKAWAY CYLINDER HEAD

[75] Inventors: Dennis E. Resch, Menomonee Falls; David C. Janssen, Milwaukee, both of Wis.

[73] Assignee: Strattec Security Corporation, Milwaukee, Wis.

[21] Appl. No.: 424,721

[22] Filed: Apr. 18, 1995

[51] Int. Cl.[6] ..... E05B 15/16

[52] U.S. Cl. ..... 70/422; 70/495; 70/496

[58] Field of Search ..... 70/379 R, 381, 70/367, 416, 417, 419, 422, 449, 452, 495, 496

[56] References Cited

U.S. PATENT DOCUMENTS

| | | | |
|---|---|---|---|
| 1,705,344 | 3/1929 | Thompson | 70/422 |
| 2,004,433 | 6/1935 | Fitz Gerald | 70/419 |
| 2,004,434 | 6/1935 | Gerald | 70/46 |
| 2,024,441 | 12/1935 | Fitz Gerald | 70/495 |
| 2,031,155 | 2/1936 | Gerald | 70/46 |
| 3,287,944 | 11/1966 | Crumb | 70/452 |
| 3,455,130 | 7/1969 | Basseches | 70/495 |
| 3,499,209 | 3/1970 | Laviana | 70/417 |
| 4,008,588 | 2/1977 | Miller et al. | 70/366 |
| 4,074,547 | 2/1978 | Seidewand | 70/1.5 |
| 4,074,548 | 2/1978 | Milton | 70/1.5 |
| 4,195,502 | 4/1980 | Best et al. | 70/224 |
| 4,413,493 | 11/1983 | Meinsen et al. | 70/422 |
| 4,454,736 | 6/1984 | Mochida | 70/422 |
| 4,550,581 | 11/1985 | Best et al. | 70/422 |
| 4,559,795 | 12/1985 | Zagoroff | 70/422 |
| 4,667,994 | 5/1987 | Foshee | 70/422 |
| 4,669,287 | 6/1987 | Reader et al. | 70/360 |
| 4,685,317 | 8/1987 | DeWalch | 70/422 |
| 4,773,240 | 9/1988 | Foshee | 70/422 |
| 5,010,755 | 4/1991 | Best | 70/422 |

*Primary Examiner*—Darnell M. Boucher
*Attorney, Agent, or Firm*—Andrus, Sceales, Starke & Sawall

[57] ABSTRACT

A mechanical lock is provided which prevents forced rotation of the cylinder when a mated key is not present in the key slot. The lock includes a cylinder rotatably supported within a sleeve. The cylinder defines a longitudinal axis and a keyway disposed along the axis for slidably receiving a key therein. A cylinder head extends circumferentially about a first end of the cylinder and includes a frangible ring portion which fractures in response to a predetermined rotational force. A tab extends from the cylinder head and includes a frangible base which also fragments in response to a predetermined rotational force. The mechanical lock further includes a sidebar for preventing rotation of the cylinder when a mated key is not present therein. The sidebar includes a rib extending therefrom which prevents the longitudinal sliding of the sidebar out of the mechanical lock when the cylinder head has been broken away from the cylinder.

27 Claims, 3 Drawing Sheets

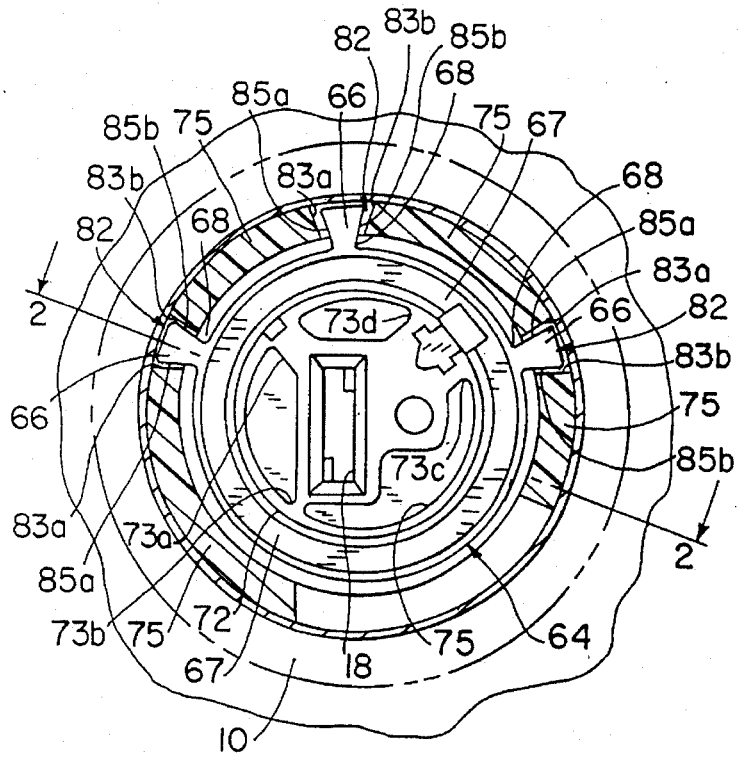
FIG. 1
FIG. 2
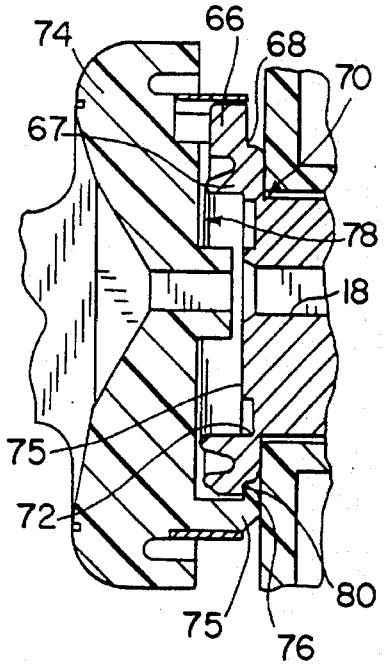
FIG. 4
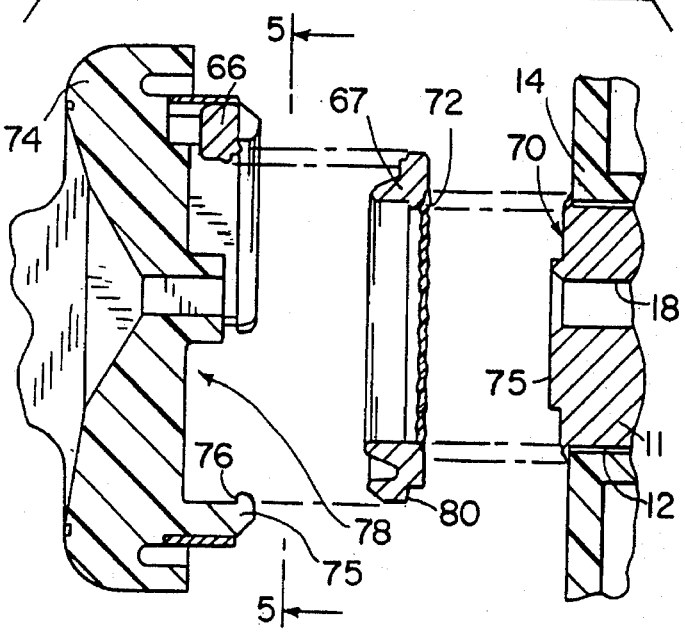

BREAKAWAY CYLINDER HEAD

BACKGROUND AND SUMMARY OF THE INVENTION

This invention relates to a mechanical lock, and in particular, to a mechanical lock which incorporates features to prevent forced rotation of the cylinder when a mated key is not present in the key slot.

A mechanical ignition lock of a motor vehicle prevents operation of the ignition switch without the use of a properly mated key. In order to defeat a motor vehicle ignition lock, automobile thieves are known to grab the head of the cylinder of the lock and forcibly rotate the cylinder to its start position so as to actuate the ignition switch.

In order to deter the thief, hardened armor elements may be incorporated into the lock. Although they may be somewhat effective, hardened armor elements are cost prohibitive and may not prevent all attempts at forced rotation of the cylinder.

Other attempts to prevent forced rotation of the cylinder of a mechanical lock are shown in Milton U.S. Pat. No. 4,074,548 and Seidewand U.S. Pat. No. 4,074,547. Both the Milton and the Seidewand patents include a breakaway cylinder head which prevents forced rotation of the cylinder of the lock. As described, however, the cylinder heads in the Milton and Seidewand patents may also fragment in response to an operator's attempt to start an automobile with a properly mated key.

Therefore, it is a primary object and feature of the present invention to provide a mechanical lock wherein the cylinder head breaks away from the cylinder in response to forced rotation of the cylinder, but will not break away in conjunction with normal operation of the ignition switch with a properly mated key.

It is a further object and feature of the present invention to provide a mechanical lock wherein the breakaway cylinder head is simple and inexpensive to manufacture.

It is a still further object and feature of the present invention to provide a mechanical lock which prevents forced rotation of the cylinder by an automobile thief.

A mechanical lock is provided having a cylinder rotatably received within a sleeve. The cylinder defines an external cylindrical surface, longitudinal axis and a keyway disposed along the axis for slidably receiving a key therein. The cylinder includes a sidebar slot extending radially with respect to the axis, and a tumbler ward extending radially from the axis at a location angularly spaced from the sidebar slot. The sidebar slot has an open inner end which opens into the tumbler ward and an open outer end which opens to the external cylindrical surface.

The cylinder further includes a sidebar groove extending longitudinally parallel to the axis and having an open end which opens into the sidebar slot.

A sidebar slidably mounted within the sidebar slot for radial movement therein. The sidebar includes a tongue at its inner end and a radially outer end, and is movable between a first cylinder locking position where the outer end of the sidebar projects from the cylinder, and a second cylinder locking position wherein the outer end of the sidebar is retracted within the sidebar slot. Sidebar springs within the cylinder bias the sidebar inwardly toward the unlocking position.

A rib extends longitudinally from the sidebar parallel to the axis. The rib is receivable within the sidebar groove for radial movement therein. The rib further includes a radially outer end which projects from the cylinder when the sidebar is in the cylinder locking position.

A tumbler is disposed in the tumbler ward for sliding movement radially with respect to the longitudinal axis. The tumbler moves between a non-aligned position with the sidebar so as to hold the sidebar in its cylinder locking position, and an aligned position with the sidebar so as to permit the sidebar to move into its cylinder unlocking position. The tumbler further includes a notch of predetermined depth along one edge. Inner section of the key in the keyway moves the tumbler from the non-aligned position to its aligned position, and thereby aligns the notch with the tongue of the sidebar. This permits the sidebar to slide radially inwardly from the locking position to the unlocking position to prevent rotation of the cylinder in the sleeve. A tumbler spring within the cylinder biases the tumbler toward the non-aligned position.

A cylinder head extends circumferentially about a first end of the cylinder. The cylinder head includes an outer head portion and a frangible base portion connecting the outer head portion to the first end of the cylinder. The frangible ring portion fractures in response to a predetermined rotational force on the outer head portion.

A tab extends from the outer head portion of the cylinder head. The tab includes tab body portion and a frangible base portion connecting the tab body portion to the outer head portion. The frangible base portion fragments in response to a predetermined rotational force on the tab body portion.

BRIEF DESCRIPTION OF THE PREFERRED EMBODIMENT

The drawings furnished herewith illustrate a preferred construction of the present invention in which the above advantages and features are clearly disclosed as well as others which will be readily understood from the following description of the illustrated embodiment.

In the drawings:

FIG. 1 is an end view partially in section of a mechanical lock incorporating a breakaway cylinder head in accordance with the present invention;

FIG. 2 is a sectional view of a portion of the mechanical lock of FIG. 1 taken along line 2—2;

FIG. 4 is a sectional view of a portion of the mechanical lock of FIG. 1 after fragmentation of the breakaway cylinder head;

DETAILED DESCRIPTION OF THE PREFERRED EMBODIMENT

Figure 6:
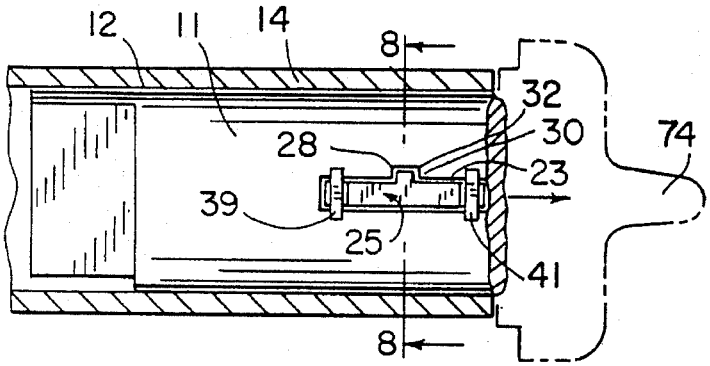
FIG. 6 is a side elevational view, partially in section, showing the mechanical lock of the present invention.

Referring to FIG. 1, a mechanical lock corresponding to the present invention generally designated by the reference numeral 10. Mechanical lock 10 includes a cylinder 11, FIG. 6, of the type that may be rotatably mounted within a sleeve member 14, which in turn is mounted in the steering column or door of an automobile. Other uses, however, are contemplated for cylinder 11 and therefore, the present invention is not limited to its use as a steering column ignition lock and/or door lock for an automobile.

Sleeve member 14 is in the form of a cylindrical, substantially hollow cylinder which defines a central longitudinal axis 16 about which cylinder 11 is rotated. Cylinder 11 includes a central keyway 18 disposed along axis 16, FIG. 7, for receiving a key (not shown) in the conventional manner to permit rotation of cylinder 11. As is conventional, keyway 18 opens up at its front end to the face of cylinder 11 and is closed at the opposite end of cylinder 11.

Figure 8:
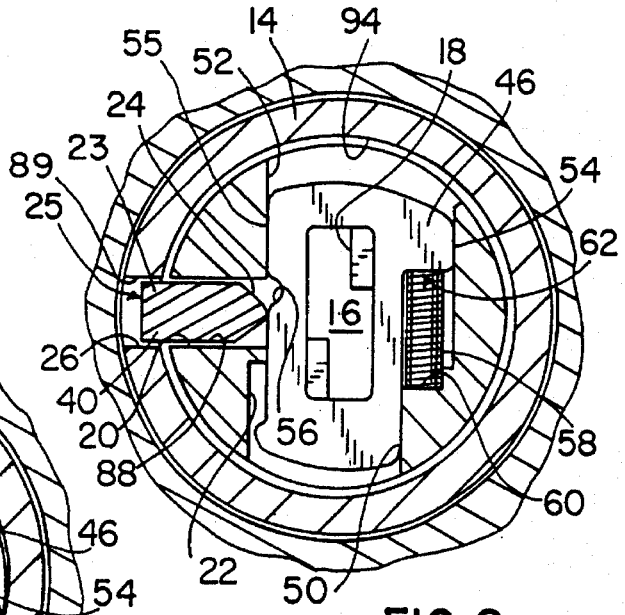
FIG. 8 is a sectional view of the mechanical lock of FIG. 6 taken along line 8—8 with the sidebar in the locking position.
Figure 9:
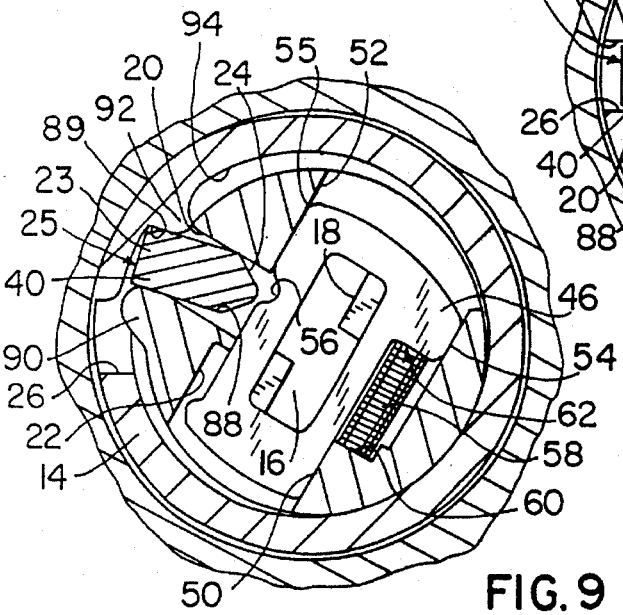
FIG. 9 is a sectional view of the mechanical lock of FIG. 6 taken along line 8—8 after an attempt to forcibly rotate the cylinder of the lock.

Cylinder 11 also includes a sidebar slot 20, FIGS. 8–9, extending transversely with respect to axis 16, i.e. radially outward from axis 16 toward the outer cylindrical surface of cylinder 11. Slot 20 has an open inner end which opens into tumbler ward 22, and an open outer end which opens to the external cylindrical surface of cylinder 11.

A sidebar 23 is slidably mounted within slot 20 for movement radially outwardly to a locking position and radially inwardly to an unlocking position. Sidebar 23 includes a tongue 24 extending longitudinally along its inner end which projects radially inward from sidebar 23 toward axis 16, and a radially outer end 25 which is employed to engage a slot 26 formed in sleeve member 14 to prevent rotation of cylinder 11 when sidebar 23 is in its locking position.

Sidebar 23 also includes a rib 28 which extends laterally along sidewall 30 of sidebar 23 from the inner end of sidebar 23 to the outer end 25. Slot 20 in cylinder 11, and slot 26 in sleeve member 14 each include a groove 32 and 34 (not shown), respectively, which accommodates rib 28 when sidebar 23 is received therein.

Figure 7:
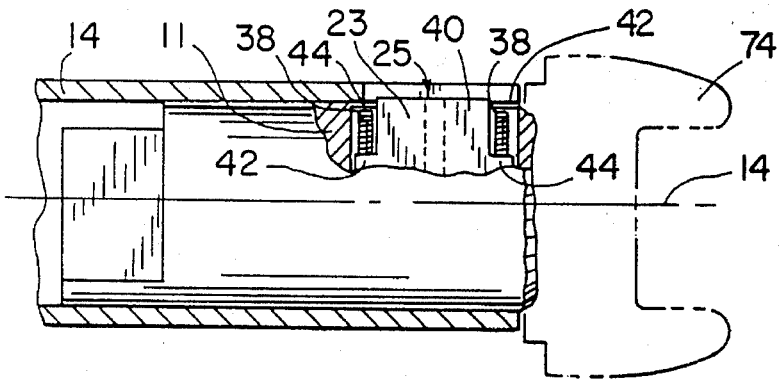
FIG. 7 is a side elevational view with portions broken away showing the mechanical lock of FIG. 6 rotated 180°.

As best seen in FIG. 7, a pair of sidebar springs 38 are disposed within cylinder 11 for biasing sidebar 23 radially inward towards axis 16, i.e. the unlocking position. Sidebar 23 includes a head 40 positioned to engage sleeve member 14 in the locking position, shown in FIGS. 7–9. Opposing legs 42 and 44 of sidebar 23 are used to provide a seat for springs 38. Thus, one spring 38 extends between one leg 42 of sidebar 23 and a plate 39, while the other spring 38 extends between the other leg 44 of sidebar 23 and a second plate 41. The plates are preferably staked in place along the outer surface of cylinder 11.

A plurality of tumblers 46 are slidably mounted within a corresponding number of tumbler slots or wards 22 contained within cylinder 11. Each ward 22, and therefore each tumbler 46, is oriented transversely in a plane passing perpendicularly through axis 16. Each ward 22 extends 90° with respect to slot 20, as is conventional, and each tumbler is slidably mounted to engage sidebar 23. As best seen in FIGS. 8–9, each ward or slot 22 is defined by opposing walls 50 and 52 in cylinder 11 which guide tumbler 46 in its sliding movement.

Each tumbler 46 includes a first outer edge 54 which slidably engages wall 50 of ward 22. Each tumbler 46 also includes a V-shaped notch 56 of a predetermined desired depth formed along second outer edge 55. The depth of notch 56 is sufficient so that when sidebar 23 is received therein, its outer end 25 is fully retracted within slot 20 to disengage from slot 26 of sleeve member 14. The tumblers 46 operate in the conventional manner by slidably moving in their respective wards 22 between a non-aligned position with the sidebar 23, holding the sidebar in its cylinder locking position, and an aligned position with sidebar 23, permitting the sidebar 23 to move to its cylinder unlocking position where tongue 24 is received within aligned notches 56 in all tumblers 46. Thus, insertion of a key in keyway 18 moves the tumblers 46 from their non-aligned positions to their aligned positions and thereby aligns the notches 56 with the tongue 24 of sidebar 23 to permit sidebar 23 to slide radially inward from its locking position to its unlocking position for rotation of cylinder 11 in sleeve member 14.

Each tumbler 46 also includes a corresponding spring 58 extending between a seat 60 formed in the sidewall 50 of cylinder 11 and a boss 62 projecting from first outer edge 54 of tumbler 46. Thus, spring 58 urges tumbler 46 in a radial direction from axis 16 and thus, biases tumbler 46 towards its non-aligned position as shown in FIGS. 8–9. It is important to note that the normal spring force of springs 58 acting on each tumbler 46 is greater than normal spring force of the sidebar springs 38 acting on sidebar 23. This permits tumblers 46 to slide with respect to sidebar 23 even though the tongue 24 of sidebar 23 engages the outer edge 55 of tumblers 46.

Figure 3:
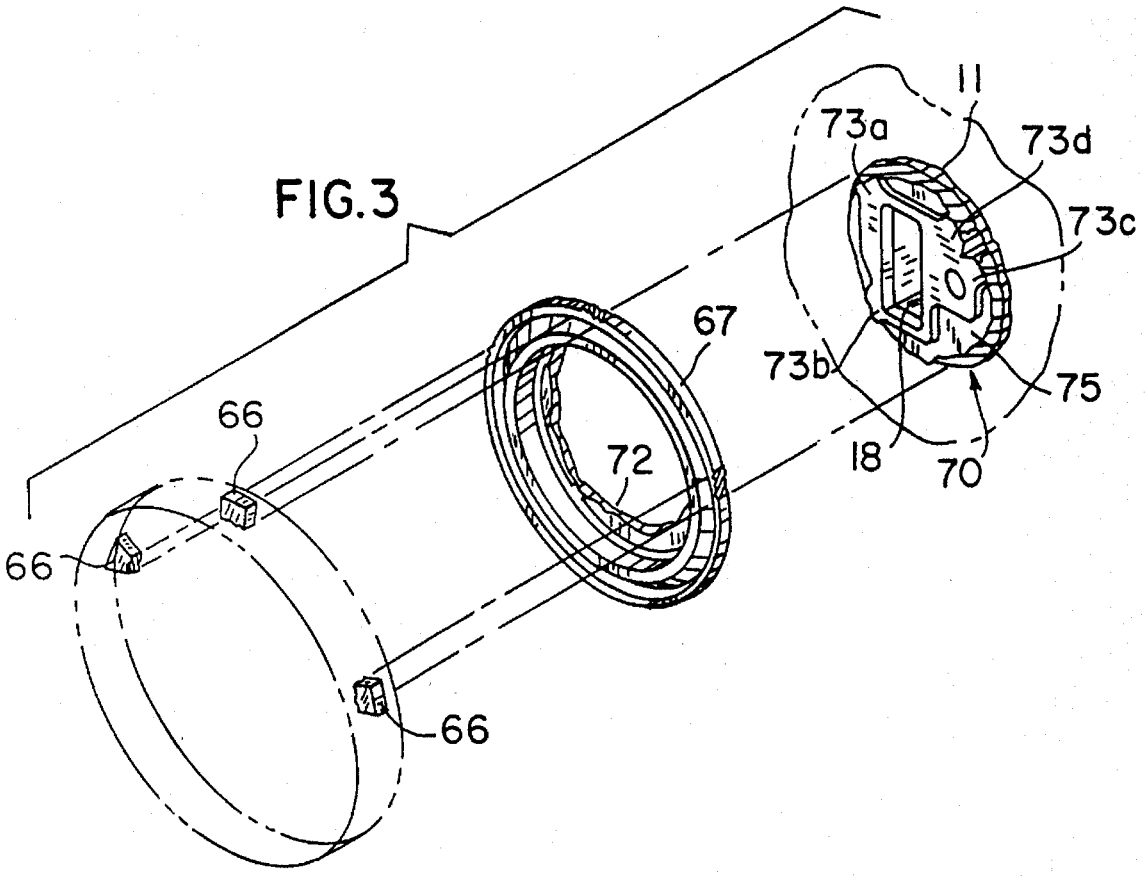
FIG. 3 is an exploded isometric view of a portion of the mechanical lock of FIG. 1 showing the sequential fragmentation of the breakaway cylinder head in accordance with the present invention.
Figure 5:
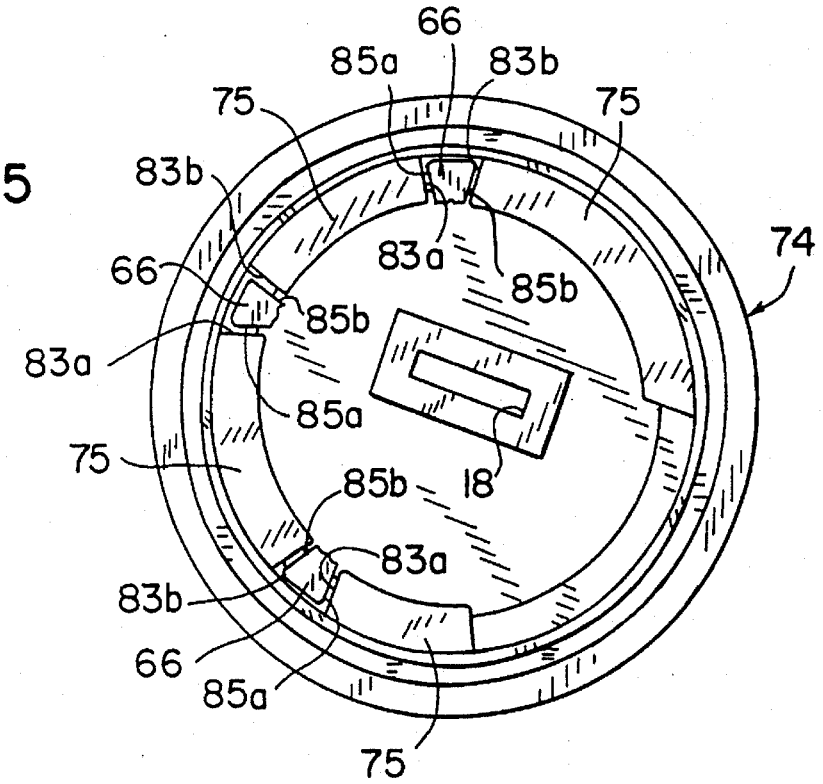
FIG. 5 is a sectional view of the mechanical lock of FIG. 4 taken along line 5—5.

Referring to FIG. 1, cylinder 11 includes a cylinder head 64 die cast thereon. Cylinder head 64 includes a plurality of circumferentially spaced projections or tabs 66 which extend radially from axis 16. Each tab 66 includes a frangible base 68 which allows the tabs 66 to break away from the outer portion 67 of cylinder head 64 in response to a predetermined rotational force on the tabs 66, as shown in FIG. 3.

Outer portion 67 of cylinder head 64 extends circumferentially about a first end 70 of cylinder 11 and is interconnected to first end 70 by a frangible ring 72 and by a series of support ribs 73*a*, 73*b*, 73*c*, and 73*d*. The frangible ring 72 has a reduced thickness relative to the outer portion 67 of cylinder head 64, which thereby facilitates the breaking away of the outer portion 67 of cylinder head 64 from the cylinder 11 in response to a predetermined rotational force exerted on the cylinder head 64.

Support ribs 73*a*–73*d* extend from the outer portion 67 of cylinder head 64 along the front surface 75 of the first end 70 of cylinder 11 toward keyway 18. The number and the thickness of support ribs 73*a*–73*d* in combination with the thickness of frangible ring 72 determines the predetermined rotational force required to break away the outer portion 67 of cylinder head 64 away from cylinder 11. As shown, support ribs 73*a*–73*d* are die cast on the front surface 75 of the first end 70 of cylinder 11.

The rotational force required to break away outer portion 67 of cylinder head 64 from cylinder 11 is greater than the rotational force required to break away tabs 66 from outer portion 67 of cylinder head 64. The difference in rotational force required to break tabs 66 away from the outer head portion 67 of cylinder head 64 in comparison to the rotational force required to break away cylinder head 64 from cylinder 11, allows tabs 66 to break away from the outer portion 67 of cylinder head 64 before the outer portion 67 of cylinder head 64 breaks off cylinder 11. This, in turn, prevents the undesired effect of accidentally breaking off the outer portion 67 of cylinder head 64 in response to an operator's attempted rotation of the cylinder 11 with a mated key therein.

A knob 74 is provided for receipt over the cylinder head 64. Knob 74 includes a plurality of resilient tangs 75 which extend from knob 74 toward sleeve member 14 when mechanical lock 10 is assembled. Each tang 75 includes a rib portion 76 directed toward longitudinal axis 16.

Knob 74 is mounted to cylinder head 64 by press fitting knob 74 over cylinder head 64 such that tangs 75 are urged radially outward away from axis 16. Cylinder head 64 is positioned in cavity 78 defined by tangs 75 such that each rib portion 76 fits over shoulder 80 of cylinder head 64, FIG. 2. When cylinder head 64 is received with cavity 78, resilient tangs 75 attempt to return to their original position such that cylinder head 64 is prevented from being removed from knob 74 without urging tangs 75 radially outward.

Pockets 82 are formed in knob 74 in order to receive tabs 66 therein when cylinder head 64 is received within cavity 78. Each pocket 82 is defined of opposing walls 83*a* and 83*b* in knob 74 which prevent rotational movement of knob 74 with respect to cylinder head 64. Each tab 66 includes a first outer edge 85*a* which engages wall 83*a* of pocket 82 when knob 74 is used in an attempt to rotate cylinder 11 in a clockwise direction. Similarly, each outer edge 85*b* of tab 66 engages corresponding wall 83*b* of pocket 82 when knob 74 is used to rotate cylinder 11 in a counterclockwise direction.

As previously described, in order to defeat a motor lock, automobile thieves are known to grab the cylinder head of the lock and forcibly rotate the cylinder to its start position so as to actuate the ignition switch.

In the mechanical lock 10 of the present invention, knob 74 is mounted to cylinder head 64, as previously described. In an attempt to steal the vehicle, an automobile thief will grab, with a wrench or the like, the outer periphery of knob 74 in order to forcibly rotate cylinder 11. A clockwise rotational force on knob 74 will cause each sidewall 83*a* of each pocket 82 in knob 74 to engage corresponding outer edge 85*a* of each tab 66. If a mated key is received within keyway 18 in cylinder 11, sidebar 23 will be fully retracted within slot 20, thereby allowing cylinder 11 to rotate within sleeve member 14. However, if a mated key is not present in keyway 18, sidebar 23 will remain in the locking position, thereby preventing rotation of cylinder 11 with respect to sleeve member 14. Because cylinder 11 is not free to rotate within sleeve member 14 when a mated key is not present in keyway 18, any rotational force on knob 74 will be translated to tabs 66 through walls 83*a* in knob 74. In response to a first predetermined rotational force upon tabs 66, the tabs 66 will break away from cylinder head 64. With tabs 66 broken away from cylinder head 64, the thief is unable to generate any additional force on cylinder 11 in an attempt to forcibly rotate cylinder 11.

If the automobile thief wishes to continue in attempting to forcibly rotate cylinder 11, the thief must first knock off knob 74 off cylinder head 64 in order to expose cylinder head 64. Once again, the automobile thief will use a wrench or the like to grab the outer periphery of cylinder head 64 in an attempt to forcibly rotate cylinder 11. As previously described, sidebar 23 resists forced rotation of cylinder 11. Consequently, in response to a predetermined rotational force on cylinder head 64, the outer portion 67 of cylinder head 64 will break away from cylinder 11, FIG. 4, when frangible ring 72 fragments.

After cylinder head 64 breaks away from the cylinder 11, there is nothing left of the cylinder head 64 for the automobile thief to grab in order to forcibly rotate cylinder 11. However, once the cylinder head has broken away from cylinder 11, sidebar 23 may be exposed to the automobile thief through the front end 70 of the face of cylinder 11. An automobile thief may attempt to slide sidebar 23 axially from slots 20 and 26 in cylinder 11 and sleeve member 14 respectively. If sidebar 23 is allowed to be removed from mechanical lock 10, cylinder 11 may be rotated with respect to sleeve member 14 even if a mated key is not present in keyway 18. However, sidebar rib 28 in grooves 32 and 34 in cylinder 11 and sleeve member 14, respectfully, prevents sidebar 23 from being slid axially from cylinder 11, thereby further deterring the automobile thief.

As a final alternative, because sidebar 23 may not be removed from mechanical lock 10, the automobile thief may attempt to force rotation of mechanical lock 10 by inserting a screwdriver or the like into the keyway 18 in the cylinder 11, to attempt to rotate the cylinder 11 therewith. As best seen in FIG. 9, any attempt to rotate the cylinder 11 while the sidebar 23 is present in slot 26 in sleeve 14, will cause cylinder 11 to deform.

As cylinder 11 is rotated while the outer end 25 of sidebar 23 is in sleeve 14, the sidewall 88 of slot 20 in cylinder 11 will engage sidebar 23 and the outer end of sidebar 23 will engage sidewall 89 of slot 26. Therefore, only rotational force exerted by sidewall 88 on sidebar 23 is resisted by the outer end 25 of sidebar 23 which engages sidewall 89 in slot 26 of sleeve member 14. In response to the resistance of sidebar 23, a portion 90 of cylinder 11 adjacent to slot 20 begins to skew. In addition, outer end 25 of sidebar 23 causes a portion 92 of sleeve member 14 along inner surface 94 to skew and deform. This, in turn, oblongs the previously cylindrical surface of cylinder 11 and deforms the inner surface of sleeve member 14. Hence, as shown in FIG. 8*b*, if an automobile thief exerts enough rotational force to cause outer end 25 of sidebar 23 to deform sleeve member 14 such that sidebar 23 exits slot 26 in sleeve member 14, outer end 25 of sidebar 23 will mesh into inner surface 94 of sleeve member 14. This, in turn, binds up lock 10 thereby preventing further rotation of cylinder 11 with respect to sleeve member 14 such that the tool typically breaks off in the lock.

Various modes of carrying out the invention are contemplated as being in the scope of the following claims, particularly pointing out and distinctly claiming the subject matter regarded as the invention.

We claim:

1. A mechanical lock comprising:

a cylinder rotatably supported within a sleeve, the cylinder defining an external cylindrical surface, a longitudinal axis and a keyway disposed along the axis for slidably receiving a key therein;

said cylinder comprising a cylinder head extending from and molded as a part of a first end of the cylinder, the cylinder head including a head portion and a frangible ring portion interconnecting the head portion to the first end of the cylinder, the frangible ring portion fracturing in response to a predetermined rotational force on the head portion; and a support rib extending from the frangible ring along the first end of the cylinder, the support rib integral with the cylinder and the frangible ring, and determining the predetermined force required to fracture the frangible ring.

2. The mechanical lock of claim 1 further comprising a tab extending from the outer head portion of the cylinder head radially with respect to the axis, the tab including a tab body portion and a frangible base portion connecting the tab body portion to the outer head portion of the cylinder head, the frangible base portion of the tab fragmenting in response to a predetermined rotational force on the tab body portion.

3. The mechanical lock of claim 1 wherein the cylinder includes a sidebar slot extending radially with respect to the axis, and a tumbler ward extending radially from the axis at a location angularly spaced from the sidebar slot, the sidebar slot having an open inner end which opens into the tumbler ward at an open outer end which opens to the external cylindrical surface;

a sidebar slidably mounted within the side bar slot for radial movement therein, the sidebar including a tongue at its inner end and a radially outer end, and is movable between a first cylinder locking position wherein the outer end of the sidebar projects from the housing, and a second cylinder unlocking position wherein the outer end of the sidebar is retracted within the sidebar slot;

sidebar springs within the cylinder for biasing the sidebar inwardly toward the unlocking position;

a tumbler disposed in the ward for sliding movement radially with respect to the axis between a non-aligned position with the sidebar, holding the sidebar in its cylinder locking position, and an aligned position with the sidebar, permitting the sidebar to move to its cylinder unlocking position, the tumbler including a notch of predetermined depth along one edge thereof whereby insertion of a key in the keyway moves the tumbler from the non-aligned position to the aligned position, and thereby aligns the notch with the tongue of the sidebar to permit the sidebar to slide radially inwardly from the locking position to the unlocking position to permit rotation of the cylinder in the sleeve; and a tumbler spring within the housing for biasing the tumbler toward its non-aligned position.

4. The mechanical lock of claim 3 wherein the cylinder further includes a rib slot extending in a direction perpendicular to the axis and having an open end which opens into the sidebar slot, and the mechanical lock further comprising, a rib extending from the sidebar, the rib receivable within the rib slot for radial movement therein.

5. The mechanical lock of claim 3 wherein the sleeve includes an internal cylindrical surface for rotatably receiving the cylinder therein, the sleeve including a sidebar slot extending radially with respect to the axis, the slot in the sleeve having an open inner end which opens to the internal cylindrical surface and aligns with the sidebar slot in the cylinder when the sidebar is in the cylinder locking position.

6. The mechanical lock of claim 3 wherein the sidebar slot in the sleeve receives the outer end of the sidebar when the sidebar is in the cylinder locking position.

7. The mechanical lock of claim 6 wherein the rib includes a radially outer end wherein the outer end of the rib projects from the cylinder when the sidebar is in the cylinder locking position and wherein the outer end of the rib is retracted within the rib slot when the sidebar is in the cylinder unlocking position.

8. The mechanical lock of claim 7 wherein the sleeve further includes a rib slot having an open end which opens into the sidebar slot in the sleeve, the rib slot in the sleeve aligned with the rib slot in the cylinder and receiving the outer end of the rib when the sidebar is in the cylinder locking position.

9. A mechanical lock, comprising:

a cylinder rotatably supported within the sleeve, the cylinder defining an external cylindrical surface, a longitudinally axis and a keyway disposed along the axis for slidably receiving a key therein, the cylinder including a sidebar slot extending radially with respect to the axis, and a tumbler ward extending radially from the axis at a location angularly spaced from the sidebar slot, the sidebar slot having an open inner end which opens into the tumbler ward and an open outer end which opens to the external cylindrical surface, the cylinder further including a rib slot extending in a direction perpendicular to the axis and having an open end which opens into the sidebar slot;

a sidebar slidably mounted within the sidebar slot for radial movement therein, the sidebar including a tongue at its inner end and in a radially outer end, and is movable between a first cylinder locking position wherein the outer end of the sidebar projects from the cylinder and a cylinder unlocking position wherein the outer end of the sidebar is retracted within the cylinder;

a rib integral with and extending from the sidebar, the rib receivable within the rib slot for radial movement therein and so as to prevent longitudinal movement of the sidebar with respect to the cylinder;

sidebar springs within the cylinder for biasing the sidebar inwardly toward the unlocking position;

a tumbler disposed in the ward for sliding movement radially with respect to the axis between a non-aligned position with the sidebar, holding the sidebar in its cylinder locking position and an aligned position with the sidebar, permitting the sidebar to move to its cylinder unlocking position, the tumbler including a notch of predetermined depth along one edge thereof where an insertion of a key in the keyway moves the tumbler from its non-aligned position to its aligned position, and thereby aligns the notch with the tongue of the sidebar to permit the sidebar to slide radially inwardly from the locking position to the unlocking position to permit rotation of the cylinder in the sleeve; and a tumbler spring within the housing for biasing the tumbler toward its non-aligned position.

10. The mechanical lock of claim 9 wherein the tumbler spring normally generates a spring force on the tumbler greater than the spring force generated by the sidebar spring on the sidebar.

11. The mechanical lock of claim 9 further comprising:

a cylinder head extending from a first end of the cylinder, the cylinder head including a head portion and a frangible ring portion connecting the outer head portion to the first end of the cylinder, the frangible ring portion fracturing in response to a predetermined rotational force on the outer head portion.

12. The mechanical lock of claim 11 further comprising:

a tab extending from the outer head portion of the cylinder head radially with respect to the axis, the tab including a tab body portion and a frangible base portion connecting the tab body portion to the outer head portion of the cylinder head, the frangible base portion fragmenting in response to a predetermined rotational force on the tab body portion.

13. The mechanical lock of claim 12 wherein the predetermined rotational force needed to fragment the frangible base portion of the tab is greater than the predetermined rotational force required to fragment the frangible ring portion of the cylinder head.

14. A mechanical lock, comprising:

a cylinder rotatably received within a sleeve, the cylinder defining an external cylindrical surface, the longitudinal axis, and a keyway disposed along the axis for slidably receiving a key therein, the cylinder including a sidebar slot extending radially with respect to the axis, and a tumbler ward extending radially from the axis at a location angularly spaced from the sidebar slot, the sidebar slot having an inner open end which opens into the tumbler ward and an open outer end which opens to the external cylindrical surface, the cylinder further including a rib slot extending in a direction perpendicular to the axis, and having an open end which opens into the sidebar slot;

a sidebar slidably mounted within a sidebar slot for radial movement therein, the sidebar including a tongue at its inner end and a radially outer end, and is movable between a first cylinder locking position wherein the outer end of the sidebar projects from the cylinder and a second cylinder locking position wherein the outer end of the sidebar is retracted within the sidebar slot;

a rib extending from the sidebar and receivable within the rib slot for radial movement therein, the rib including a radially outer end which projects from the cylinder when the sidebar is in the cylinder locking position;

sidebar springs within the cylinder for biasing the sidebar inwardly toward the unlocking position;

a tumbler disposed in the ward for sliding movement radially with respect to the axis between a non-aligned position with the sidebar, holding the sidebar in its cylinder locking position, and an aligned position with the sidebar, permitting the sidebar to move to its cylinder unlocking position, the tumbler including a notch of predetermined depth along one edge thereof whereby rotation of a key in the keyway moves the tumbler from the non-aligned position to its aligned position, and thereby aligns the notch with the tongue of the sidebar to permit the sidebar to slide radially inwardly from the locking position to the unlocking position to permit rotation of the cylinder in the sleeve;

a tumbler spring within the housing for biasing the tumbler toward its non-aligned position;

a cylinder head extending from a first end of the cylinder, the cylinder head including a head portion and a frangible ring portion connecting the outer head portion to the first end of the cylinder, the frangible ring portion fracturing in response to a predetermined rotational force on the outer head portion; and a tab extending from the outer head portion of the cylinder head radially with respect to the axis, the tab including a tab body portion and a frangible base portion connecting the tab body portion to the outer head portion of the cylinder head, the frangible base portion fragmenting in response to a predetermined rotational force on the tab body portion.

15. The mechanical lock of claim 14 wherein the predetermined rotational force required to fragment the frangible ring of the cylinder head is greater than the predetermined rotational force required to fragment the frangible base portion of the tab.

16. A mechanical lock comprising:

a cylinder rotatably supported within a sleeve, the cylinder defining an external cylindrical surface, a longitudinal axis and a keyway disposed along the axis for slidably receiving a key therein;

said cylinder comprising a cylinder head extending from and molded as a part of a first end of the cylinder, the cylinder head including a head portion and a frangible ring portion interconnecting the head portion to the first end of the cylinder, the frangible ring portion fracturing in response to a predetermined rotational force on the head portion; and a tab integral with and extending radially with respect to the axis from the head portion of the cylinder head, the tab including a tab body portion and a frangible base portion connecting the tab body portion to the head portion of the cylinder head, the frangible base portion of the tab fragmenting in response to a second predetermined rotational force on the tab body portion.

17. The mechanical lock of claim 16 further comprising a support rib extending from the frangible ring along the first end of the cylinder, the support rib determining the predetermined force required to fragment the frangible ring.

18. The mechanical lock of claim 16 wherein the cylinder includes a sidebar slot extending radially with respect to the axis, and a tumbler ward extending radially from the axis at a location angularly spaced from the sidebar slot, the sidebar slot having an open inner end which opens into the tumbler ward at an open outer end which opens to the external cylindrical surface;

a sidebar slidably mounted within the side bar slot for radial movement therein, the sidebar including a tongue at its inner end and a radially outer end, and is movable between a first cylinder locking position wherein the outer end of the sidebar projects from the housing, and a second cylinder unlocking position wherein the outer end of the sidebar is retracted within the sidebar slot;

sidebar springs within the cylinder for biasing the sidebar inwardly toward the unlocking position;

a tumbler disposed in the ward for sliding movement radially with respect to the axis between a non-aligned position with the sidebar, holding the sidebar in its cylinder locking position, and an aligned position with the sidebar, permitting the sidebar to move to its cylinder unlocking position, the tumbler including a notch of predetermined depth along one edge thereof whereby insertion of a key in the keyway moves the tumbler from the non-aligned position to the aligned position, and thereby aligns the notch with the tongue of the sidebar to permit the sidebar to slide radially inwardly from the locking position to the unlocking position to permit rotation of the cylinder in the sleeve; and a tumbler spring within the housing for biasing the tumbler toward its non-aligned position.

19. The mechanical lock of claim 18 wherein the cylinder further includes a rib slot extending in a direction longitudinally perpendicular to the axis and having an open end which opens into the sidebar slot, and the mechanical lock further comprising, a rib extending from the sidebar, the rib receivable within the rib slot for radial movement therein.

20. The mechanical lock of claim 18 wherein the sleeve includes an internal cylindrical surface for rotatably receiving the cylinder therein, the sleeve including a sidebar slot extending radially with respect to the axis, the slot in the sleeve having an open inner end which opens to the internal cylindrical surface and aligns with the sidebar slot in the cylinder when the sidebar is in the cylinder locking position.

21. The mechanical lock of claim 18 wherein the sidebar slot in the sleeve receives the outer end of the sidebar when the sidebar is in the cylinder locking position.

22. The mechanical lock of claim 21 wherein the rib includes a radially outer end wherein the outer end of the rib projects from the cylinder when the sidebar is in the cylinder locking position and wherein the outer end of the rib is retracted within the rib slot when the sidebar is in the cylinder unlocking position.

23. The mechanical lock of claim 22 wherein the sleeve further includes a rib slot having an open end which opens into the sidebar slot in the sleeve, the rib slot in the sleeve aligned with the rib slot in the cylinder and receiving the outer end of the rib when the sidebar is in the cylinder locking position.

24. The mechanical lock of claim 16 wherein the first predetermined rotational force is greater than the second predetermined rotational forces.

25. A mechanical lock, comprising:

a cylinder rotatably received within a sleeve, the cylinder defining an external cylindrical surface, the longitudinal axis, and a keyway disposed along the axis for slidably receiving a key therein, the cylinder including a sidebar slot extending radially with respect to the axis, the sidebar slot having an inner end and an open outer end which opens to the external cylindrical surface, the cylinder further including a rib slot extending in a direction perpendicular to the axis, and having an open end which opens into the sidebar slot;

a sidebar slidably mounted within a sidebar slot for radial movement therein, the sidebar including a tongue at its inner end and a radially outer end, and is movable between a first cylinder locking position wherein the outer end of the sidebar projects from the cylinder and a second cylinder unlocking position wherein the outer end of the sidebar is retracted within the sidebar slot; and a rib extending from the sidebar and receivable within the rib slot for radial movement therein, the rib including a radially outer end which projects from the cylinder when the sidebar is in the cylinder locking position.

26. The mechanical lock of claim 25 further comprising:

a cylinder head extending from a first end of the cylinder, the cylinder head including a head portion and a frangible ring portion connecting the outer head portion to the first end of the cylinder, the frangible ring portion fracturing in response to a predetermined rotational force on the outer head portion; and a tab extending from the outer head portion of the cylinder head radially with respect to the axis, the tab including a tab body portion and a frangible base portion connecting the tab body portion to the outer head portion of the cylinder head, the frangible base portion fragmenting in response to a predetermined rotational force on the tab body portion.

27. The mechanical lock of claim 26 wherein the predetermined rotational force required to fragment the frangible ring of the cylinder head is greater than the predetermined rotational force required to fragment the frangible base portion of the tab.

* * * * *